US006176567B1

(12) United States Patent
Uno et al.

(10) Patent No.: US 6,176,567 B1
(45) Date of Patent: Jan. 23, 2001

(54) DIRECT PRINTING APPARATUS WITH AUTOMATIC CLEANING OF EXCESS PRINT PARTICLES

(75) Inventors: Koji Uno, Kobe; Toshio Yamaki, Takatsuki; Hirokatsu Shimada, Machida; Yoshifumi Shibata; Hiroshi Hiraguchi, both of Toyokawa, all of (JP)

(73) Assignees: Minolta Co., Ltd., Osaka (JP); Array Printers AB, Vastra Frolunda (SE)

( * ) Notice: Under 35 U.S.C. 154(b), the term of this patent shall be extended for 0 days.

(21) Appl. No.: 09/382,132

(22) Filed: Aug. 24, 1999

(30) Foreign Application Priority Data

Aug. 25, 1998 (JP) ..... 10-238662

(51) Int. Cl.[7] ..... B41J 2/385
(52) U.S. Cl. ..... 347/55; 347/22; 347/33
(58) Field of Search ..... 347/151, 155, 347/117, 55, 22, 33; 399/99, 100, 101

(56) References Cited

U.S. PATENT DOCUMENTS 4,478,510 * 10/1984 Fujii et al. ..... 347/55
4,755,837 * 7/1988 Schmidlin et al. ..... 347/55
5,132,708 7/1992 Schmidlin et al. .
5,477,250 12/1995 Larson ..... 347/55

FOREIGN PATENT DOCUMENTS 3-253879 * 11/1991 (JP) .
8-281998 * 10/1996 (JP) .
9-30031 * 2/1997 (JP) .

* cited by examiner

*Primary Examiner*—Joan Pendegrass
(74) *Attorney, Agent, or Firm*—Morrison & Foerster LLP

(57) ABSTRACT

The present invention provides a direct printing apparatus which prevents noise at a time of operation, downsizes the apparatus, prevents decrease of strength, and enables to certainly clean remaining printing particles. An endless belt member 92 disposed between a backing electrode 44 and a printing head 50 of printing station 16, the endless belt member 92 receiving the printing particles 38 which are propelled from the printing head and cleaning means for cleaning the printing particles adhering to the surface of the endless belt member are provided, whereby the printing particles adhering to the apertures of the printing head are collected on the endless belt member so that the printing particles are recovered by the cleaning means. Concretely, the backing electrode is applied with a voltage of opposite polarity to the printing particles adhering to the printing head whereby the printing particles adhering to the apertures of the printing head is cleaned.

5 Claims, 8 Drawing Sheets

| | | | | | | | |
|---|---|---|---|---|---|---|---|
| Color of Toner | Magenta | | Cyan | | Yellow | | Black |
| Charge Quantity of Toner | Small | | Small | | Middle | | Large |
| Voltage $V_{BE}$ | Va (1000V) | = | Vb (1000V) | < | Vc (1200V) | < | Vd (1500V) |
| Intensity of Electric Field | Ea | = | Eb | < | Ec | < | Ed |

DIRECT PRINTING APPARATUS WITH AUTOMATIC CLEANING OF EXCESS PRINT PARTICLES

This application is based on application No. H10-238662 filed in Japan on Aug. 25, 1998, the content of which is hereby incorporated by reference.

FIELD OF THE INVENTION

The present invention relates to a direct printing apparatus for use in a color copying machine and printer.

BACKGROUND OF THE INVENTION

U.S. Pat. No. 5,132,708 discloses a direct printing apparatus. In the direct printing apparatus, four printing stations are disposed on an outer periphery of a drum-like sheet conveying member along a sheet conveying direction. On an outer periphery of a toner carrier in each printing station is retained toner having different colors, for example, magenta, cyan, yellow and black.

Moreover, in the direct printing apparatus, a plurality of aspirators comprising a vacuum cleaner and the like are provided inside the sheet conveying member. Each aspirator sucks the sheet to hold it on the outer periphery of the sheet conveying member and sucks the toner adhering to each printing station to clean the printing station at a cleaning time after printing operation.

However, the direct printing apparatus as described above utilizes the aspirator comprising the vacuum cleaner, thereby there is a disadvantage that a noise is caused when operating the aspirator. The aspirator is provided inside the sheet conveying member, thereby there is an another disadvantage that the apparatus is enlarged. In addition, since the sheet is sucked by the aspirator, it is necessary to form a number of holes in the sheet conveying member. Thereby, there is a further disadvantage that the strength of the sheet conveying member becomes weakened.

SUMMARY OF THE INVENTION

Accordingly, the present invention has been accomplished to solve the aforementioned disadvantages of the prior arts. An object of the present invention is to provide a direct printing apparatus which is possible to remove remaining printing particles to clean the printing station without causing noise, enlargement of the apparatus, and decrease of strength of the sheet conveying member.

In order to achieve the aforementioned object, according to a first aspect of the present invention, there is provided a direct printing apparatus, comprising:

printing means having a bearing member for bearing printing particles thereon, the printing particles being charged to a predetermined polarity, a backing electrode opposed to the bearing member, the backing electrode generating electric field which attracts the printing particles, and a printing head disposed between the bearing member and the backing electrode, the printing head having a plurality of apertures through which the printing particles can propel and a plurality of control electrodes disposed around the plurality of apertures;

an endless belt member disposed between the backing electrode and the printing head of the printing means, the endless belt member receiving the printing particles which are propelled from the printing means; and cleaning means for cleaning the printing particles adhering to the surface of the endless belt member;

whereby the printing particles adhering to the apertures of the printing head are collected on the endless belt member so that the printing particles are recovered by the cleaning means.

Preferably, the backing electrode is applied with a voltage of opposite polarity to the printing particles adhering to the printing head, whereby the printing particles adhering to the apertures of the printing head is cleaned.

Among the printing particles, there exists wrong-sign printing particles that are charged to a reverse polarity to the predetermined polarity. The wrong-sign printing particles remain on the lower surface of the printing head without propelling to the backing electrode from the printing head under the electric field generated by the backing electrode. In the direct printing apparatus having above described construction, the wrong-sign printing particles adhering to the apertures of the printing head are collected on the endless belt member by applying the backing electrode with a voltage of opposite polarity to the printing particles adhering to the printing head, whereby the wrong-sign printing particles are recovered by the cleaning means. Thus, the apertures of the printing head are surely prevented from clogging off. The cleaning mechanism of the present invention is not based on a suction method by such a vacuum cleaner as the prior art, preventing noise and enlargement of the apparatus. In addition, the cleaning mechanism of the present invention needs not to form a number of holes in the endless belt member, preventing decrease of strength of the sheet conveying member.

According to a second aspect of the present invention, there is provided a direct printing apparatus, comprising:

printing means having a bearing member for bearing printing particles thereon, the printing particles being charged to a predetermined polarity, a backing electrode opposed to the bearing member, the backing electrode generating electric field which attracts the printing particles, and a printing head disposed between the bearing member and the backing electrode, the printing head having a plurality of apertures through which the printing particles can propel and a plurality of control electrodes disposed around the plurality of apertures;

an endless belt member disposed between the backing electrode and the printing head of the printing means, the endless belt member receiving the printing particles which are propelled from the printing means; and cleaning means disposed on the endless belt member, the cleaning means coming into contact with the printing head to remove the printing particles adhering to the aperture of the printing head as the endless belt member moves.

Preferably, printing particle collecting means for collecting the printing particles which is cleaned by the cleaning means is provided in the vicinity of the endless belt member.

In the direct printing apparatus having above described construction, the printing particles adhering to the aperture of the printing head are removed by directly bringing the cleaning means into contact with the printing head, whereby the wrong-sign printing particles remaining on the printing head are surely removed and recovered.

Preferably, the endless belt means is an intermediate transfer means, and wherein a transfer means for transferring an image of the printing particles formed on the surface of the endless belt means into a print medium is provided. Alternatively, the endless belt means is a conveyance means for conveying a print medium, and wherein the printing means print an image of printing particles directly onto the print medium. As described above, either an intermediate transfer method or a direct printing method can be adopted as a printing method to the printing medium.

Preferably, a plurality of the printing means are provided along the moving direction of the endless belt member in order to implement color print.

BRIEF DESCRIPTION OF THE DRAWINGS

Further objects and advantages of the present invention will become clear from the following description taken in conjunction with the preferred embodiments thereof with reference to the accompanying drawings, in which.

DETAILED DESCRIPTION OF THE PREFERRED EMBODIMENTS

Figure 1:
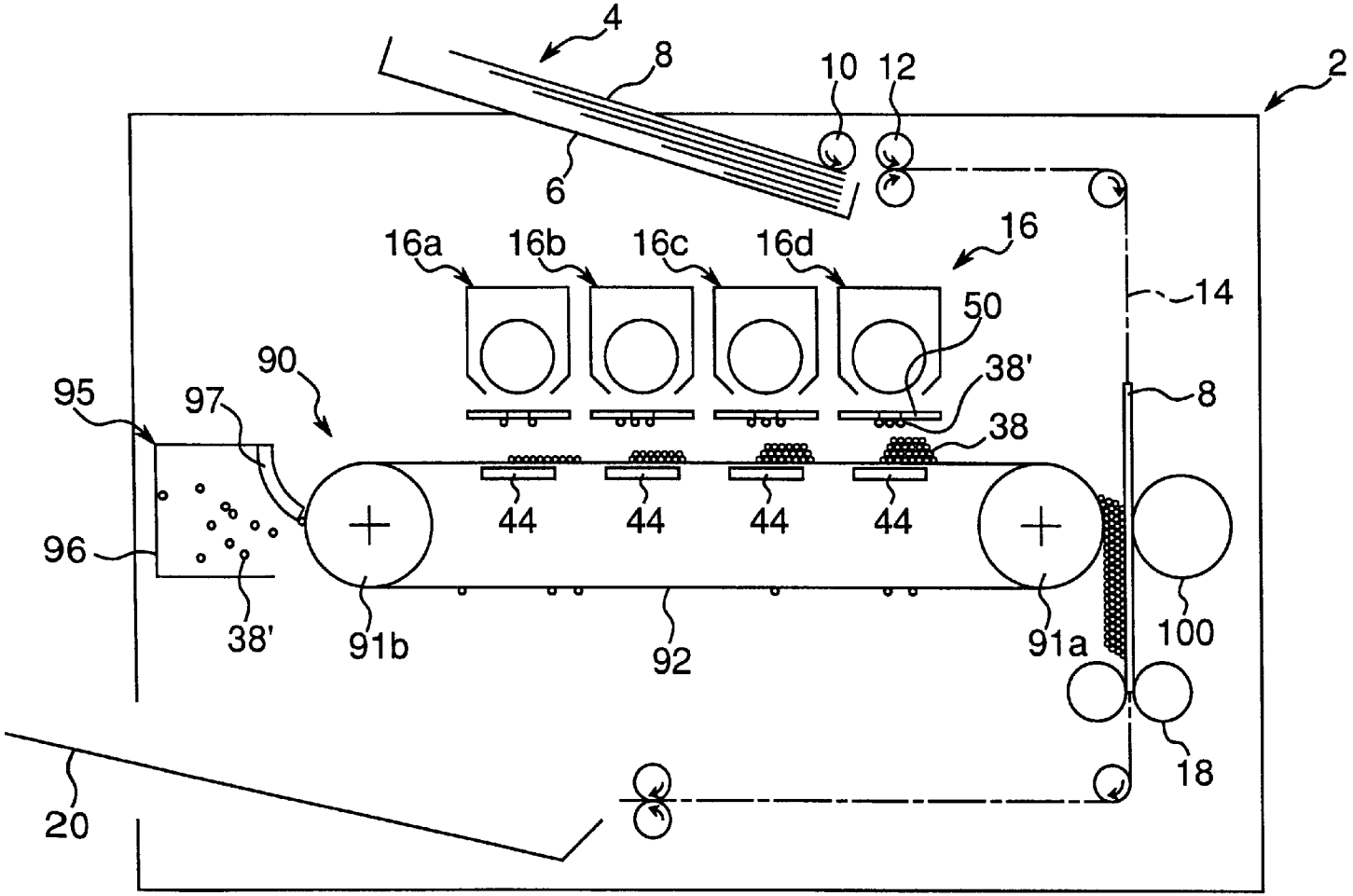
FIG. 1 is a schematic cross-sectional side elevational view of a first embodiment of a direct printing apparatus of the present invention.

With reference to the drawings and, in particular, to FIG. 1, there is shown a tandem type of direct printing apparatus, generally indicated by reference numeral 2, according to a first embodiment of the present invention. The printing apparatus 2 has a sheet feed station generally indicated by reference numeral 4. The sheet feed station 4 includes a cassette 6 in which a number of sheets 8 or plain papers are stacked. A sheet feed roller 10 is mounted for rotation above the cassette 6 so that it can frictionally contact with the top sheet 8, thereby the feed roller 10 can feed the top sheet 8 into the direct printing apparatus 2 as it rotates. A pair of timing rollers 12 are arranged adjacent to the sheet feed roller 10, for supplying the sheet 8 fed from the cassette 6 through a sheet passage 14 indicated by a dotted line into a transfer nip portion between an intermediate transfer device 90 and a transfer roller 100. On the intermediate transfer device 90 is disposed a printing station, generally indicated by reference numeral 16, where a printing material is deposited on the sheet to form an image thereon. Further, the printing apparatus 2 includes a fusing station 18 for fusing and permanently fixing the image of printing material on the sheet 8, and a final stack station 20 for catching the sheets 8 on which the image has been fixed.

The printing station 16 comprises four printing stations 16*a*, 16*b*, 16*c* and 16*d* equally spaced along an endless belt 92 of the intermediate transfer device 90 as described in detail hereinafter. These printing stations 16*a*, 16*b*, 16*c* and 16*d* have essentially same construction respectively and therefore one printing station, for example, the printing station 16*a* will be explained hereinafter.

Figure 2:
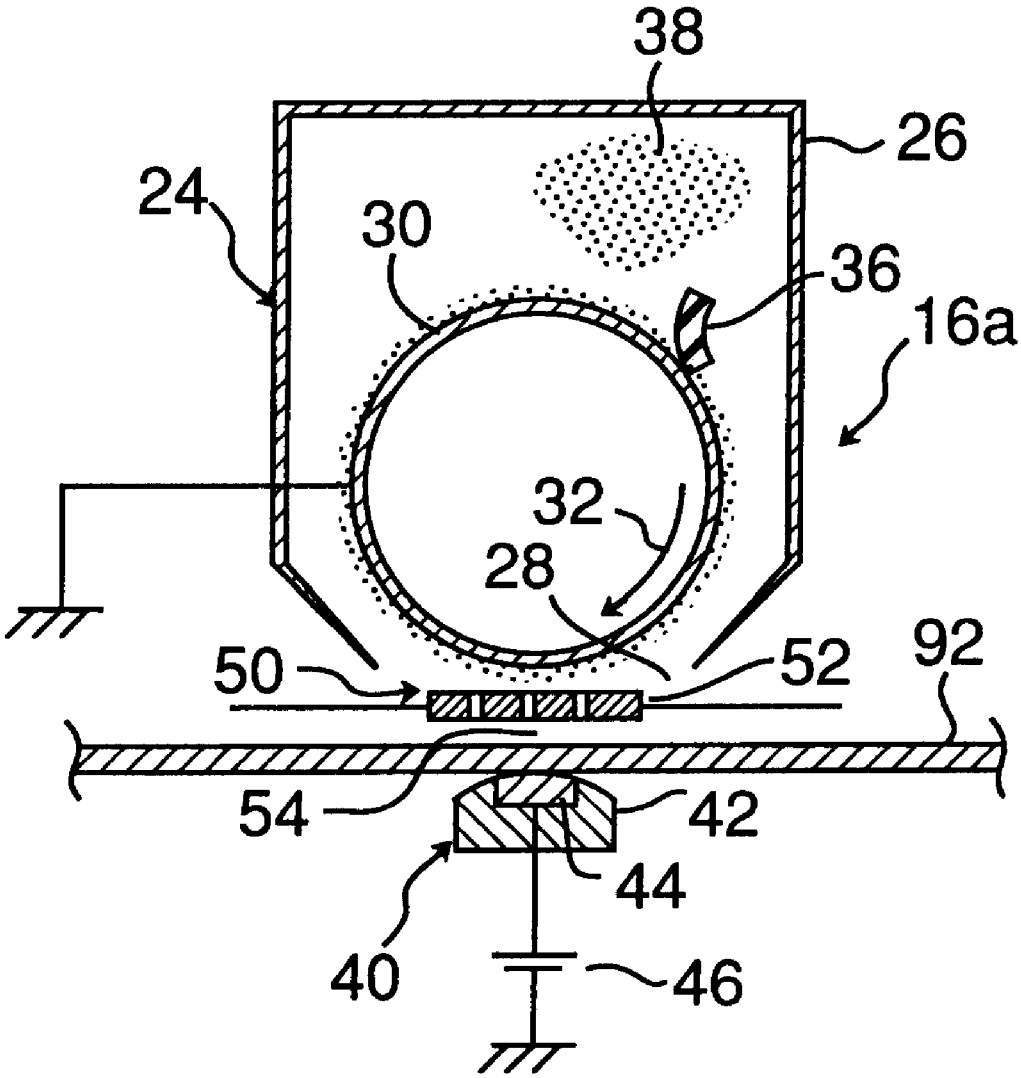
FIG. 2 is a cross-sectional side elevational view of a printing station.

Referring to FIG. 2, the printing station 16*a* comprises a developing device generally indicated by reference numeral 24 above the endless belt 92. The developing device 24 comprises a container 26 which has an opening 28 confronting the sheet passage 14. Adjacent the opening 28, a developing roller 30 as a bearing member of printing particles according to the present invention is supported for rotation in a direction indicated by an arrow 32. The developing roller 30 is made of conductive material and is electrically connected to the earth. A blade 36, preferably made from a plate of elastic material such as rubber or stainless steel, is disposed in contact with the developing roller 30.

The container 26 accommodates printing particles, i.e., toner particles 38. In this embodiment, the toner particles capable of being charged with negative polarity by the contact with the blade 36 are used. The color of the toner particles 38 at each of the printing stations 16*a*, 16*b*, 16*c* and 16*d* is different from each other. For example, the color of the toner particles 38 is magenta at the printing station 16*a*, cyan at the printing station 16*b*, yellow at the printing station 16*c* and black at printing station 16*d*, thereby color printing is possible.

Disposed under the endless belt 92 is an electrode mechanism generally indicated by reference numeral 40 so that the electrode mechanism 40 is opposed to the developing roller 30 of the developing device 24. The electrode mechanism 40 includes a support 42 made of electrically insulative material and a backing electrode 44 made of electrically conductive material. The backing electrode 44 is electrically connected to a direct power supply 46 which supplies a voltage of predetermined polarity (positive polarity in this embodiment) Thus, between the backing electrode 44 and the developing roller 30 are formed an electric field E that the negatively charged toner particles 38 on the developing roller 30 are electrically attracted to the backing electrode 44.

Figure 3:
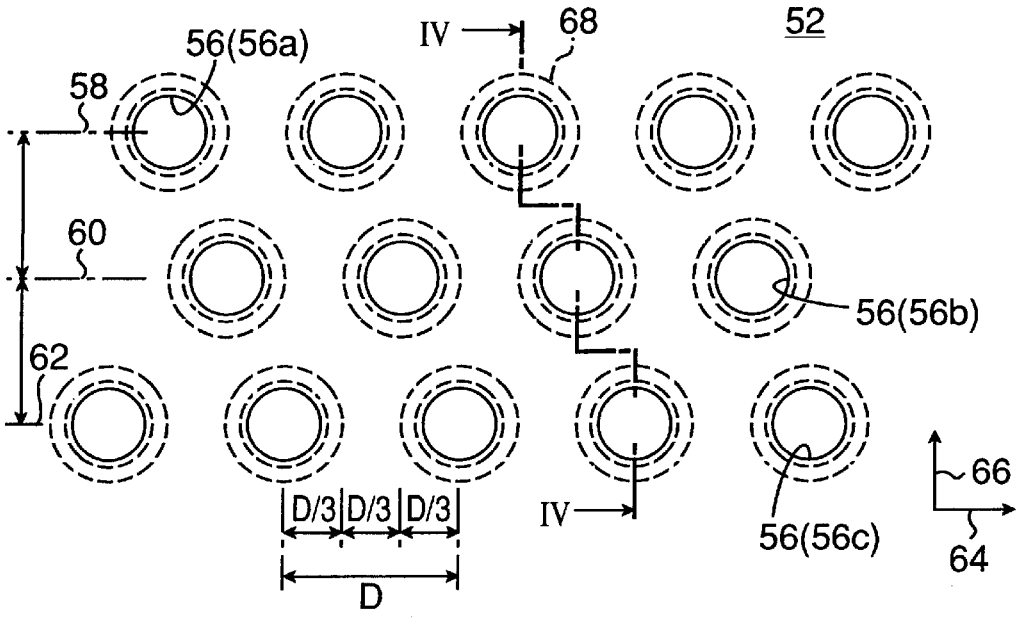
FIG. 3 is an enlarged fragmentary plane view of a printing head.

Fixed between the developing device 24 and the electrode mechanism 40 and above the endless belt 92 is a printing head generally indicated by reference numeral 50. Preferably, the printing head 50 is made from a flexible printed circuit board 52, having a thickness of about 100 to 150 micrometers. As shown in FIGS. 2 and 3, a portion of the printing head 50 located in a printing zone where the developing roller 30 confronts the backing electrode 44 includes a plurality of apertures 56 having a diameter of about 25 to 200 micrometers which is substantially larger than an average diameter (about several micrometers to a dozen micrometers) of the toner particles 38.

In this embodiment, as best shown in FIG. 3, the apertures 56 are formed on equally spaced three parallel lines 58, 60 and 62 each extending in a direction indicated by reference numeral 64 which is parallel to an axis of the developing roller 30 and perpendicular to a direction indicated by reference numeral 66 along which the sheet 8 will be transported, ensuring the printing head 50 with a resolution of 600 dpi. The apertures 56 on the lines 58, 60 and 62 are formed at regular intervals of D, e.g., 127 micrometers, and the apertures 56(56*a*) and 56(56*c*) on the lines 58 and 62 are shifted by the distance D/N to the opposite directions with respect the apertures 56(56*b*) on the central line 60, respectively, so that, when viewed from the sheet transporting direction 66, the apertures 56 appear to be equally spaced. Note that the number N represents the number of line rows and is "3" in this embodiment, however, the number N as well as the interval D can be determined depending upon the required resolution of the print head.

The flexible printed circuit board 52 further includes therein doughnut-like first and second electrodes 68 and 70 each of which surrounding the apertures 56. The first electrode 68 is disposed on one side opposing the developing roller 30 while the second electrode 70 is on the other side opposing the backing electrode 44.

The first electrode 68 is electrically communicated with a driver 72 through a printed wire 74 and the second electrode 70 is electrically communicated with a driver 76 through a printed wire 78, so that the drivers 72 and 76 can transmit image signals to the first and second electrodes 68 and 70, respectively. The drivers 72 and 76 are in turn electrically communicated with a controller 80 that feeds out data of image to be reproduced by the printing apparatus 2.

The image signals to be transmitted to the first and second electrodes 68 and 70 consist of a DC component constantly applied to the first and second electrodes 68, 70 and a pulse component applied to the first and second electrodes 68, 70 in response to the image data from the controller 80 for forming dots on the sheet 8.

In the concrete, in this embodiment, for the first electrode 68, the base voltage V1(B) is about −50 volts, and the pulse voltage V1(P) is about +300 volts. For the second electrode 70, the base voltage V2(B) is about −100 volts and the pulse voltage V2(P) is about +200 volts.

Figure 5:
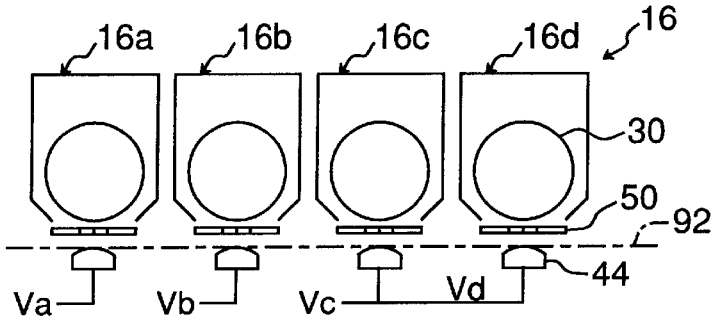
FIG. 5 is a schematic cross-sectional side elevational view of the printing stations showing a condition that a voltage applied to the backing electrode is varied in accordance with a charge quantity of printing particles at each printing station.

The intensity of the electric field E generated between the developing roller 30 and the backing electrode 44 is different from each other at the printing stations 16*a*, 16*b*, 16*c* and 16*d* in accordance with the charge quantity of the toner particles 38 at each of the printing stations 16*a*, 16*b*, 16*c* and 16*d*. As a parameter of the intensity of the electric field E, in this embodiment, the voltage $V_{BE}$ applied to the backing electrode 44 is used. That is to say, as shown in FIG. 5, the voltage Va, Vb applied to the upstream-side first and second printing stations 16*a*, 16*b* respectively in which magenta, cyan toner particles 38 of small charge quantity are used respectively are set at same values. The voltage Vc applied to the downstream-side third printing stations 16*c* in which yellow toner particles 38 of middle charge quantity is used is set at a larger value than the voltage Va, Vb in the upstream-side first and second printing stations 16*a*, 16*b*. Moreover, the voltage Vd applied to the most downstream-side fourth printing stations 16*d* in which black toner particles 38 of large charge quantity is used is set at a larger value than the voltage Vc in the upstream-side third printing stations 16*c*.

The intermediate transfer device 90 comprises the endless belt 92 driven by a pair of conveyor rollers 91*a* and 91*b*. The upper part of the endless belt 92 is disposed between the printing head 50 of the printing station 16 and the backing electrode 44. Beneath the upper part of the endless belt 92 are disposed the backing electrodes 44 for the printing stations 16*a*, 16*b*, 16*c* and 16*d*. Thus, the intermediate transfer device 90 is arranged so that the toner particle layer can be formed on the endless belt 92. As the material of the endless belt 92, fluororesin with electric conductivity and the like can be used.

The transfer roller 100 comes into contact with the transfer belt 92 on the one conveyor roller 91*a* of the intermediate transfer device 90. The transfer roller 100 is so arranged to apply a voltage of reverse polarity to the charged toner particles 38 into the sheet 8 conveyed along the sheet passage 14 and adsorb the toner particles 38 on the sheet. On the transfer belt 92 on the other conveyor roller 91*b* is provided a belt cleaner 95 as the cleaning means of the endless belt 92. The belt cleaner 95 comprises a waste toner case 96 and a blade 97 fixed on the open edge of the waste toner case 96.

Having described the construction of the printing apparatus 2, its operation will now be described.

Figure 4:
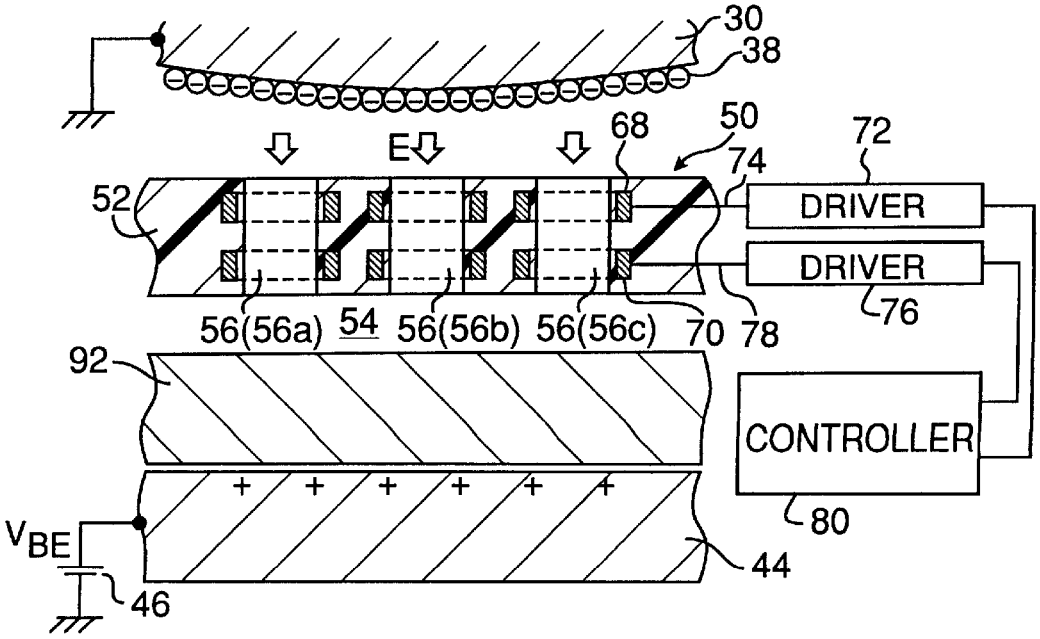
FIG. 4 is an enlarged fragmentary cross-sectional view of the printing head, developing roller and backing electrode taken along a line IV—IV in FIG. 3.

As shown in FIG. 2, in the first printing station 16*a*, the developing roller 30 rotates in the direction indicated by the arrow 32. The toner particles 38 are deposited on the developing roller 30 and then transported by the rotation of the developing roller 30 into a contact region of the blade 36 and the developing roller 30 where the toner particles 38 are provided with triboelectric negative charge by the frictional contact of the blade 36. Thereby, as shown in FIG. 4, incremental peripheral portions of the developing roller 30 which has passed through the contact region bear a thin layer of charged toner particles 38.

The backing electrode 44 is applied with a voltage of about 1000 bolts. In the printing head 50, the first and second electrodes 68 and 70 are constantly biased to the base voltage V1(B) of about −50 volts and V2(B) of about −100 volts. Therefore, the negatively charge toner particle 38 on the developing roller 30 electrically repels against the first and second electrodes 68 and 70 and therefore stays on the developing roller 30 without propelling toward the aperture 56.

The controller 80 outputs the image data corresponding to a magenta image to be reproduced to the drivers 72 and 76. In response to the image data, the drivers 72 and 76 supplies the respective voltages V1(P) of about +300 volts and V2(P) of about +200 volts to the pairs of first and second electrodes 68 and 70. As a result, the toner particles 38 on the portions of the developing roller 30 confronting the biased electrodes are electrically attracted by the first and second electrodes 68 and 70. This energizes a number of toner particles 38 to propel by the attraction force of the backing electrode 44 into the opposing aperture 56.

When the toner particles 38 have reached respective positions adjacent to the first and second electrodes 68 and 70, the voltages to be applied to the first and second electrodes 68 and 70 are changed from the pulse voltages V1(P) and V2(P) to base voltages V1(B) and V2(B), at respective timings. As a result, the toner particles 38 in the aperture 56 are then forced radially inwardly by the repelling force from the first and second electrodes 68 and 70 applied with the base voltages V1(B) and V2(B), respectively, and then converged into a mass. The converged mass of the toner particles 38 are then deposited on the endless belt 92 which is moving past the printing zone 54, thereby forming a layer of the magenta toner particles on the endless belt 92. The aforementioned second electrode 70 is provided mainly for the purpose of converging the mass of the toner particles 38. Therefore, the second electrode 70 can be excluded if necessary.

In the same manner, in the second printing station 16*b*, a layer of cyan toner particles is formed over the layer of magenta toner particles formed by the first printing station 16*a*. Then, in the third printing station 16*c*, a layer of yellow toner particles is formed over the layer of cyan toner particles formed by the second printing station 16*b*. Finally, in the fourth printing station 16*d*, a layer of black toner particles is formed over the layer of yellow toner particles formed by the third printing station 16*c*. Thus, a desired color image is formed on the endless belt 92.

The color image of toner particles layer formed on the endless belt 92 is conveyed to the transfer nip portion between the conveyor roller 91*a* and the transfer roller 100 as the endless belt 92 moves. Then, the color image is transferred to the sheet 8 which is fed to the transfer nip portion from the sheet feed station 4. As a result, the desired image is formed on the sheet 8.

Subsequently, the sheet 8 to which the image consists of the layers of the toner particles 38 is formed is transported in the fusing station 18 where the layers of the toner particles 38 are fused and permanently fixed on the sheet 8 and finally fed out onto the final stack station or catch tray 20.

In the transfer process for transferring the image formed on the endless belt 92 to the sheet 8 at the transfer nip portion, all of the toner particles 38 are not thoroughly transferred to the sheet 8 but some toner particles remain on the endless belt 92. The remaining toner particles 38 are conveyed to the belt cleaner 95 as the endless belt 95 moves. Then, the remaining toner particles 38 are scraped from the endless belt 92 by the blade 97 of the belt cleaner 95 and recovered into the waste toner case 96.

In each printing station 16, among the toner particles 38, there exist toner particles 38' that are not charged to the negative polarity but the positive polarity. The toner particles of positive polarity 38' (wrong-sign toner particles) remain on the surface of the printing head 50 without propelling toward the endless belt 92 when the toner particles layer is formed on the endless belt 92.

So, in the first embodiment of the present invention, a cleaning process for removing the remaining toner particles 38' on the printing head 50 after the end of the printing process is provided. In the cleaning process, the backing electrode 44 of each of the printing stations 16*a* to 16*d* is applied with a voltage of reverse polarity to that in the printing process, namely, about −1000 bolts, about −1000 bolts, about −1200 bolts and about −1500 bolts, respectively. As a result, the remaining toner particles 38' adhering to the printing head 50 are propelled toward the endless belt 92 due to an attractive force of the backing electrode 44 and collected on the endless belt 92.

The toner particles 38' adhering to the endless belt 92 are moved to pass through the transfer nip portion between the conveyor roller 91*a* and the transfer roller 100 and conveyed to the belt cleaner 95 as the endless belt 92 moves. Then, the toner particles 38' are scraped from the endless belt 92 by the blade 97 of the belt cleaner 95 and recovered into the waste toner case 96.

Thus, in the direct printing apparatus 2 of the present embodiment, the wrong-sign toner particles 38' adhering to the printing head 50 are collected on the endless belt 92 by applying the backing electrode 44 with a voltage of reverse polarity, whereby the wrong-sign toner particles 38' are recovered by the belt cleaner 95. As a result, the apertures 56 of the printing head 50 are surely prevented from clogging off due to the toner particles 38' deposited on the printing head 50. The cleaning mechanism of the present embodiment is not based on a suction method by such a vacuum cleaner as the prior art, preventing noise and enabling to minimize the apparatus as compared with the prior art.

Figure 6:
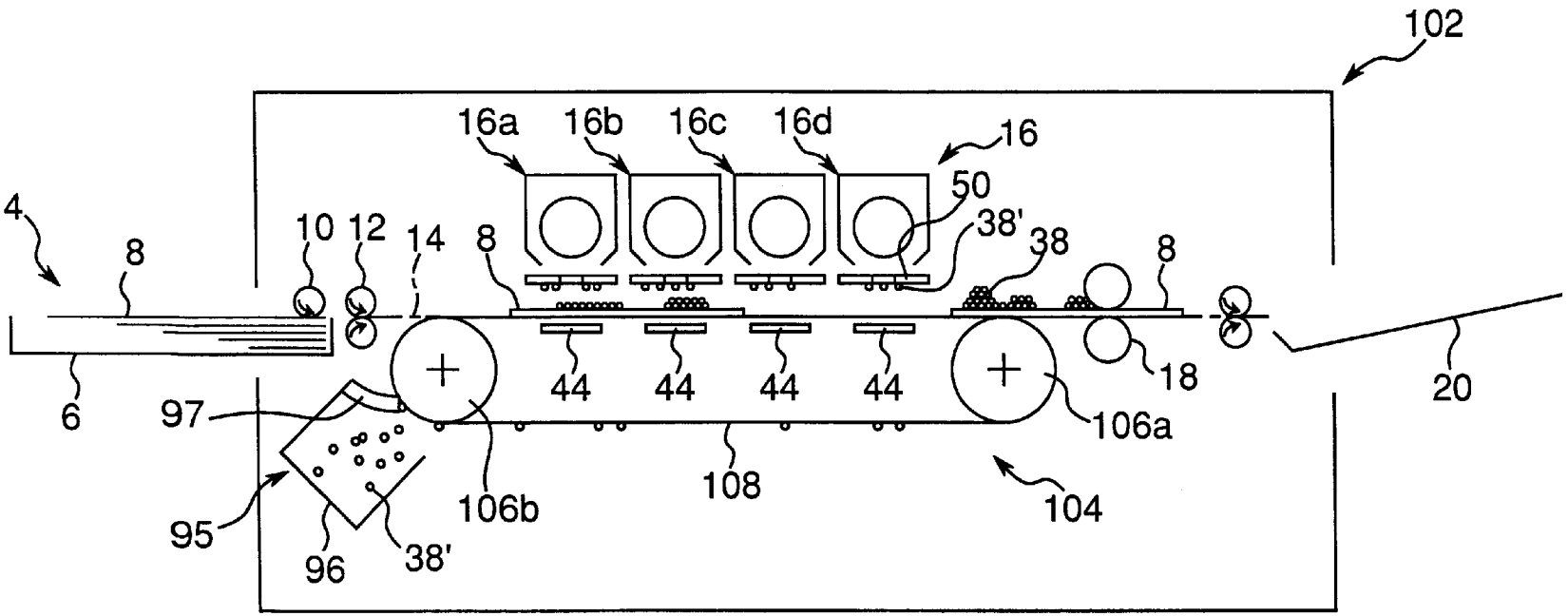
FIG. 6 is a schematic cross-sectional side elevational view of a second embodiment of a direct printing apparatus of the present invention.

FIG. 6 shows a direct printing apparatus 102 according to a second embodiment of the present invention. The direct printing apparatus 102 is same as the aforementioned direct printing apparatus 2 of the first embodiment except that the sheet 8 is put on the endless belt 108 constituting a sheet conveying device 104 and that the toner particles 38 are directly deposited on the sheet 8. Therefore, same parts are affixed with same numerals to omit the explanation thereof.

The sheet conveying device 104 comprises the endless belt 108 driven by a pair of conveyor rollers 106*a* and 106*b*. The upper part of the endless belt 108 is disposed on the sheet passage 14 to convey the sheet 8 thereon. Beneath the upper part of the endless belt 108 are disposed the backing electrodes 44 for the printing stations 16*a*, 16*b*, 16*c* and 16*d* in the same manner as in the first embodiment.

In the direct printing apparatus 102 of the second embodiment, the toner particles 38 propelled from each printing station 16 are deposited on the sheet 8 conveyed through the sheet passage 14 to form a desired image. In the cleaning process at the non printing time, the backing electrode 44 is applied with a voltage of reverse polarity in the same manner as in the first embodiment. As a result, the remaining toner particles 38' adhering to the printing head 50 are collected on the endless belt 108 and recovered by the belt cleaner 95.

Thus, the direct printing apparatus 102 in the second embodiment of the present invention, as described above in the first embodiment, prevents noise and enables to minimize the apparatus as compared with the prior art.

In the prior art using the suction method, it is necessary to form a number of holes in the endless belt 108 as the sheet conveying member, thereby there is a disadvantage that the strength of the endless belt 108 becomes weakened. However,. the direct printing apparatus 102 in the second embodiment of the present invention eliminates such disadvantage in the prior art.

Figure 7:
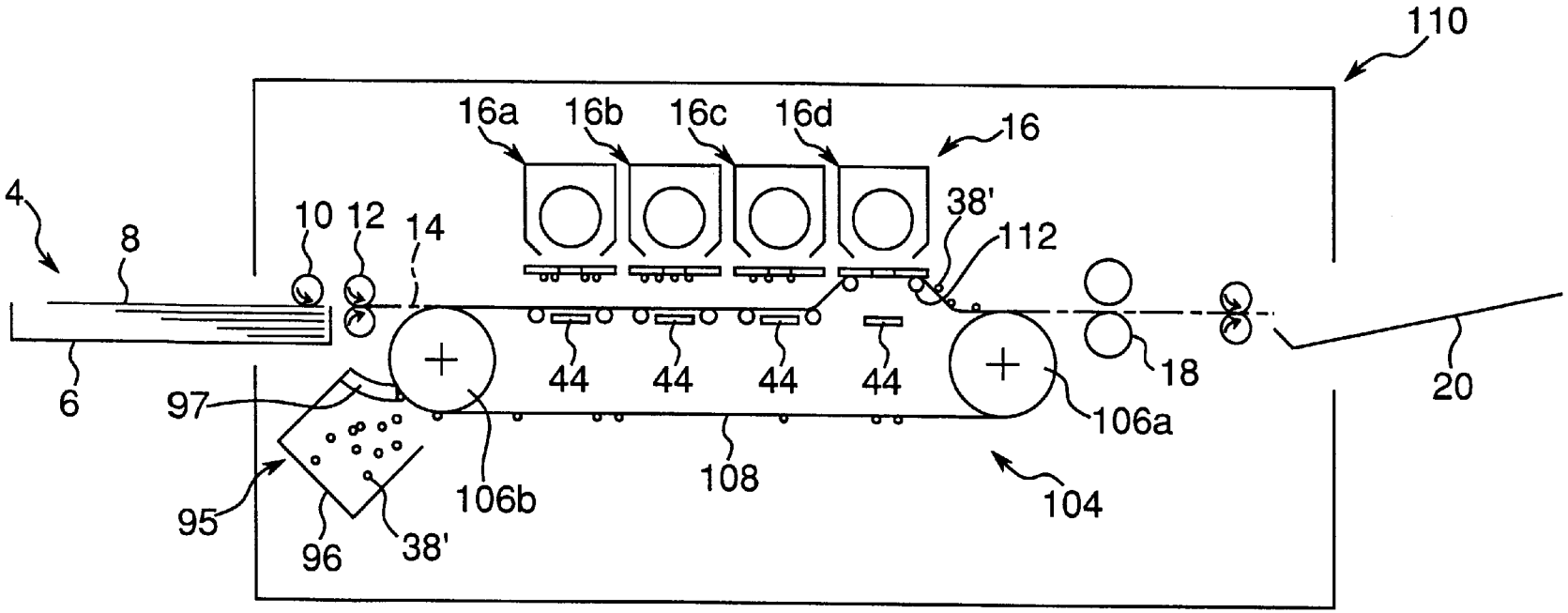
FIG. 7 is a schematic cross-sectional side elevational view of a third embodiment of a direct printing apparatus of the present invention.

FIG. 7 shows a direct printing apparatus 110 according to a third embodiment of the present invention. The direct printing apparatus 110 is different from the first and second embodiments in that the remaining toner particles 38' adhering to the printing head 50 are removed not by the electrostatic method but by the mechanical method.

Concretely, in the third embodiment, under the endless belt 108 are disposed four lifts 112 which are opposed to the printing stations 16*a*, 16*b*, 16*c* and 16*d* respectively, whereby the endless belt 108 is possible to come into contact with the printing head 50 to serve as the cleaning means of the present invention. Each of the lifts 112 comprises a pair of rollers 113, 113 which are elongated in a direction of the width of the endless belt 108 and a lifting mechanism which is possible to lift up and down the rollers 113, 113.

For example, the lifting mechanism comprises a pair of T-shaped frames 114, 114 for rotatably supporting the pair of rollers 113, 113. On the side edges of the lower portions of the frames 114,114 are formed racks 115, 115 that engage with the driven gears 116*a*, 116*b* connected with each other by a shaft 117. The driven gears 116*a* is connected with a drive gear 119 fixed on an output shaft of a motor 118.

Figure 8:
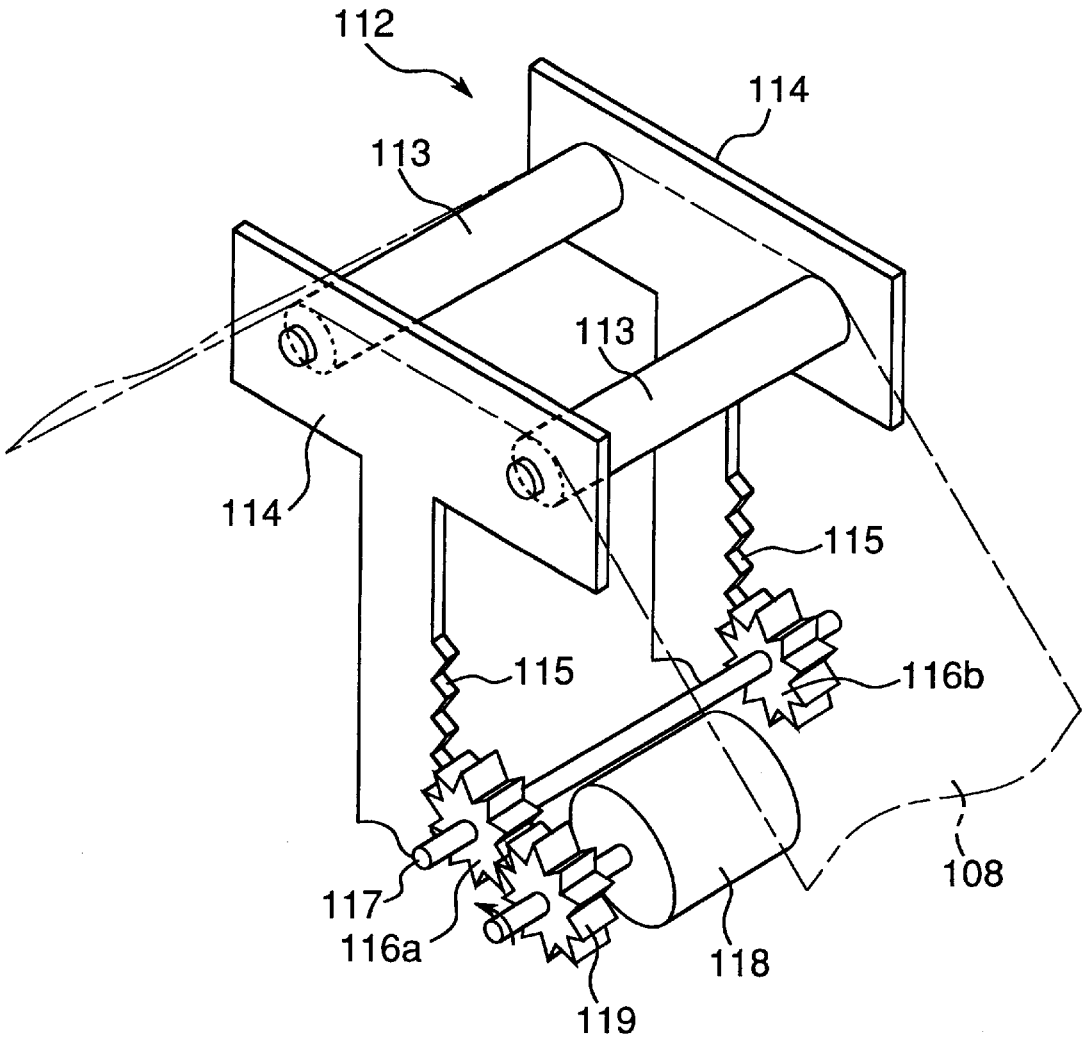
FIG. 8 is a perspective view of a lift in the third embodiment of FIG. 7.

In the direct printing apparatus 110 of the third embodiment, the motor 119 of the lift 112 is energized at the non printing time so that the drive roller 119 is rotated in a direction of arrow shown in FIG. 8. Then, the pair of driven rollers 116*a*, 116*b* rotate and the racks 115, 115 move to lift up the pair of frames 114, 114. As a result, the endless belt 108 comes into contact with the printing head 50, whereby the toner particles 38' adhering to the printing head 50 are surely removed and adhere to the endless belt 108. Then, the toner particles 38' adhering to the endless belt 108 are recovered by the belt cleaner 95 in the same manner as in the second embodiment.

As the lifting mechanism of the lift 112, any other known mechanism such as cylinder may be used. In FIG. 7, although the direct printing method as shown in the second embodiment is used as the printing method on the sheet 8, the intermediate transfer method as shown in the first embodiment may be also used.

Figure 9:
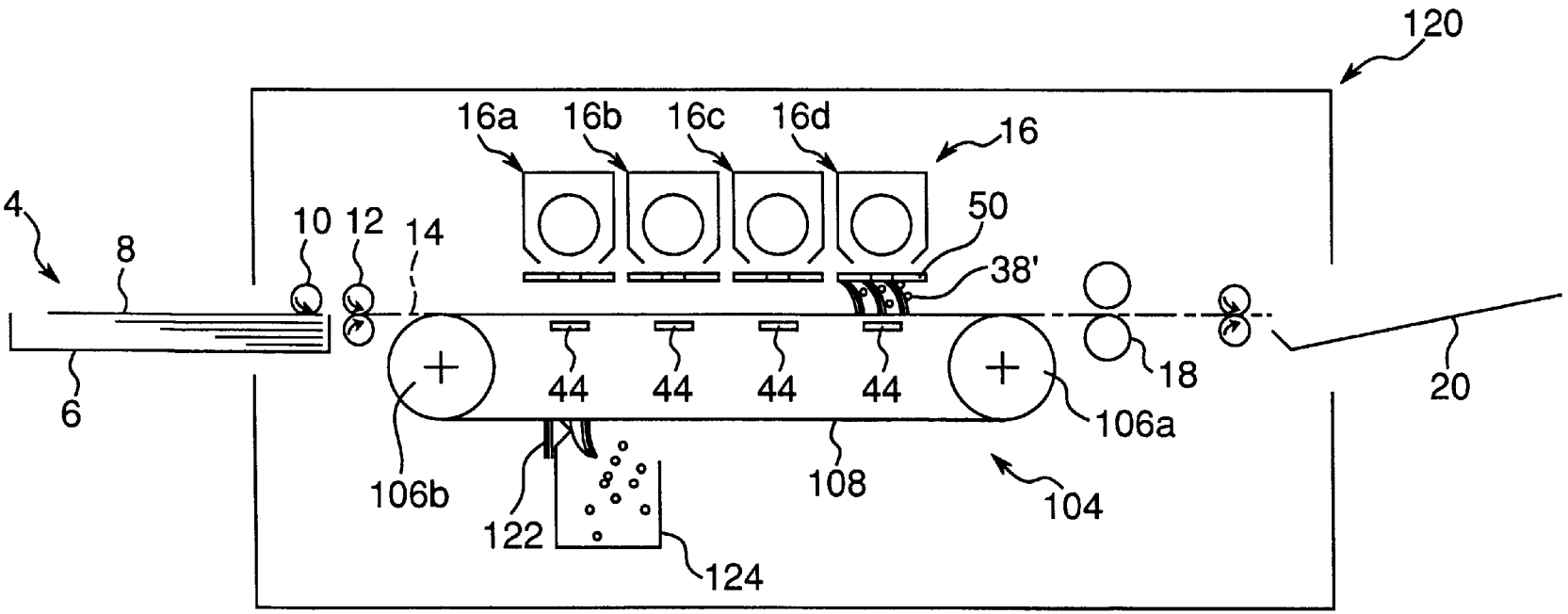
FIG. 9 is a schematic cross-sectional side elevational view of a fourth embodiment of a direct printing apparatus of the present invention.

FIG. 9 shows a direct printing apparatus 120 according to a fourth embodiment of the present invention. In the direct printing apparatus 120, a cleaning member comprising a blush 122 is provided on the endless belt 108 constituting the sheet conveying means. In stead of the belt cleaner 95 in the aforementioned embodiments, a waste toner box 124 is also provided under the endless belt 108. As the cleaning member, a film or blade may be provided in stead of the blush 122. In FIG. 9, although the direct printing method is used as the printing method in the same manner as in the third embodiment, the intermediate transfer method may be also used.

In the fourth embodiment, the sheet 8 is fed on the endless belt 108 from the timing roller 12 after the blush 122 passes. An desired image is formed on the sheet 8 by the printing station 16 and fixed by the fixing station 18. Then, the sheet 8 on which the image is formed is discharged on the stack station 20. After printing one sheet, the blush 122 comes into contact with each of the printing stations 16*a*, 16*b*, 16*c* and 16*d* to remove and recover the toner particles 38' remaining on and adhering to the printing head 50. Due to the rotation of the endless belt 108, the toner particles 38' are conveyed to the waste toner box 124 in such a condition that the toner particles 38' adhere to the blush 122. Then, the blush 122 comes into friction contact with the waste toner box 124, whereby the toner particles 38' are recovered in the waste toner box 124.

As described above, in the direct printing apparatus 120 of the fourth embodiment, the wrong-sign toner particles 38' adhering to the printing head 50 can be removed and recovered every time when one sheet is printed. As a result, it is surely prevented that the remaining toner particles 38' are accumulated on the printing head 50 to clogging the aperture 56 off.

Although the direct printing apparatuses in the aforementioned embodiments are tandem types, the present invention is applicable to a monochrome type of direct printing apparatus using single developing device.

In stead of the endless belt 92 constituting the intermediate transfer device 90 and the endless belt 108 constituting the sheet conveying means, a circular drum may be used.

Although the belt cleaner 95 with the blade 97 is used in the first to third embodiments, a belt cleaner with a blush or roller may be used.

Although the present invention has been fully described by way of the examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A direct printing apparatus, comprising:

printing means having a bearing member for bearing printing particles thereon, the printing particles being charged to a predetermined polarity, a backing electrode opposed to the bearing member, the backing electrode generating electric field which attracts the printing particles, and a printing head disposed between the bearing member and the backing electrode, the printing head having a plurality of apertures through which the printing particles can be propelled and a plurality of control electrodes disposed around the plurality of apertures;

an endless belt member disposed between the backing electrode and the printing head of the printing means, the endless belt member receiving the printing particles which are propelled from the printing means; and cleaning means for cleaning the printing particles adhering to the surface of the endless belt member;

whereby during a period of printing, the printing particles remaining on the surface of the endless belt member are recovered by the cleaning means; and during a period of non-printing, the printing particles adhering to the apertures of the printing head are collected on the endless belt member so that the printing particles are recovered by the cleaning means.

2. A direct printing apparatus as claimed in claim 1, wherein a voltage of opposite polarity to the printing particles is applied to the backing electrode, whereby the printing particles adhering to the apertures of the printing head are recovered.

3. A direct printing apparatus as claimed in any one of claims 1 and 2, wherein the endless belt means is an intermediate transfer means, and wherein a transfer means for transferring an image of the printing particles formed on the surface of the endless belt means into a print medium is provided.

4. A direct printing apparatus as claimed in any one of claims 1 and 2, wherein the endless belt means is a conveyance means for conveying a print medium, and wherein the printing means prints an image of printing particles directly onto the print medium.

5. A direct printing apparatus as claimed in any one of claims 1 and 2, wherein a plurality of the printing means are provided along the moving direction of the endless belt member.

* * * * *